United States Patent [19]

Strunkmann-Meister

[11] Patent Number: 4,796,757

[45] Date of Patent: Jan. 10, 1989

[54] VESSEL

[76] Inventor: Karl E. Strunkmann-Meister, 40, Clemensstr. 78, F.R.G., 8000 Munich, Fed. Rep. of Germany

[21] Appl. No.: 55,887

[22] Filed: Jun. 1, 1987

[30] Foreign Application Priority Data

Jun. 2, 1986 [DE] Fed. Rep. of Germany ..... 3618507

[51] Int. Cl.[4] ..... B65D 21/00; B65D 85/30

[52] U.S. Cl. ..... 206/509; 206/511

[58] Field of Search ..... 206/508, 509, 503, 505, 206/511

[56] References Cited

U.S. PATENT DOCUMENTS

| | | | |
|---|---|---|---|
| 2,627,991 | 2/1953 | Maersch | 220/4 |
| 3,616,943 | 11/1971 | Brink | 206/508 |
| 3,856,178 | 12/1974 | Norgaard | 206/509 |
| 3,931,890 | 1/1976 | Davis | 206/508 |
| 3,954,178 | 5/1976 | Mason, Jr. | 206/508 |
| 3,989,142 | 11/1976 | Gwilliam, Jr. et al. | 206/508 |
| 4,341,357 | 7/1982 | De Filippo | 206/509 |
| 4,386,701 | 6/1983 | Galer | 206/509 |
| 4,491,233 | 1/1985 | Johnson | 206/509 |
| 4,545,487 | 10/1985 | Asmus | 206/509 |

FOREIGN PATENT DOCUMENTS

| | | |
|---|---|---|
| 2163302 | 7/1973 | Fed. Rep. of Germany . |
| 7530942 | 9/1975 | Fed. Rep. of Germany . |

*Primary Examiner*—Joseph Man-Fu Moy

*Attorney, Agent, or Firm*—Fleit, Jacobson, Cohn & Price

[57] ABSTRACT

The dish vessel consists of vessel components which may in particular be used as plate or pot. On the rim the vessel components show a profile of elevations and depressions arranged in such manner that the profiles of two vessel components seated on one another and facing each other, interlock positively. The profiles are elevations having an arc-like cross-section and protruding out of the rim in longitudinal cross-sectional direction and/or depressions running into the rim, which show at one side in direction to the rim essentially perpendicular cheeks and at the remaining sides merge without steps into the rim. The surfaces of the cheeks are essentially perpendicular to a connecting line from the central point of the vessel component to the center of the cheeks.

33 Claims, 3 Drawing Sheets

VESSEL

BACKGROUND OF THE INVENTION

The invention relates to a vessel consisting of vessel components which can in particular be used as plate or pot, said components showing on the rims a profile of elevations and depressions arranged such that the structural shapes of two vessel components seated on one another and facing each other, interlock with one another positively.

A vessel of the above-described kind is known from the German published patent application 2 163 302. In this known vessel the profiles only slightly extend above and below the surface of the vessel rim and thus are comparatively unobtrusive and decorative. The profiles of two vessel components seated on one another and facing each other, do interlock in positive manner, however, in practice they do not provide the required security with respect to a lateral displacement of the vessel components.

From the German utility model 75 30 942 dish plates are known comprising two equal, cup-shaped vessel components which can be put on one another as lower component and cover with the vessel rims in open position against each other, wherein the elevated and depressed rim structures mate each other when the components are seated on one another. Said vessel components are circular and the rim elevations and depressions are uniformly arranged at such intervals and in the direction of the circumference show such wave forms or slopes that they slide into one another into an interlocked position when one component is positioned on the other. The higher such rim elevations and depressions are, the better the vessel components will be fixed in closed position. Therefore from the point of view of the technology high elevations and deep depressions in the rim are desirable, they are, however, not desired for aesthetic reasons. If the rim elevations and depressions are given a flat structure for aesthetic reasons, the desired fixation of the two vessel components is lost.

From the U.S. Pat. No. 2,627,991 a dish vessel is known, having protrusions and recesses engaging with one another when the components lie on one another, in its rim and its bottom. The four sides of the elevations and/or the depressions, respectively, run in essentially perpendicular direction to the rim surface so that cup-like depressions are created in which food remnants may gather which remnants can be removed only with difficulty. Furthermore it is very difficult to include protrusions and recesses of that kind into an aesthetic shape of the rim of the vessel component.

SUMMARY OF THE INVENTION

In view of the above, it is an object of the invention to shape the vessel such that all components of the vessel can be easily cleaned and that the structural shape appears to be an aesthetic shaping or can easily be integrated into the aesthetic form of the rim of the vessel component.

It is a further object to ensure a firm fixation of both vessel components, when such components are positioned on one another even with respect to a lateral displacement of the two vessel components.

The vessel according to the present invention is characterized in that the profiles are elevations with an arc-like cross-section and protruding from the rim in longitudinal cross-section and/or depressions running into the rim, which at one end have cheeks being essentially perpendicular to the rim, wherein the surfaces of the cheeks are essentially perpendicular to a perpendicular to a connecting line between the center of the vessel component and the center of the cheeks.

In the vessel according to the present invention, a good sealing of the vessel is achieved and a lateral displacement of the vessels with respect to one another is avoided in that the elevations and depressions mutually are in positive mesh and in that the cheeks prevent a lateral displacement of the vessel components. In the dish vessel according to the present invention, the technical function is solved with the most economical means in the sense that the casual observer, e.g. a guest in a restaurant, eating from a cup-shaped vessel component, acknowledges the wave-like form of the plate rim as being quite peculiar, however, not as a completely unusual and therefore an aesthetic shape requiring that one gets used to it. The aesthetic form of the plate rim will be regarded as being satisfactory when the plate rim differs as little as possible from the level plate rim being familiar to the user, for the consumers got used to the hitherto applied shaping of the plate rims and they show almost no inclination to accept different shapes of the plate rims. For example, a strongly wave-like form of the plate rim would be objected to as being too unusual. As the depressions at the sides with the exception of the cheeks steplessly merge into the plate rim the danger is reduced, too, that food remnants gather in the depressions, and cleaning of the vessel components is easy.

A preferred embodiment of the vessel according to the present invention is characterized in that the cheeks of the elevations and depressions are arranged at the inner side of the elevations and depressions. In this arrangement it is extremely simple to include the elevations and depressions into the aesthetic decoration of the vessel component without the functional features being lost therein.

A further preferred embodiment of the dish vessel consists in that the cheeks of the elevations and depressions are arranged at the inside and/or the outside of the elevations and depressions. A higher stability against shifting results from the keying of the engaging elevations with the depressions, when two vessel components are positioned on one another.

A further preferred embodiment of the dish vessel according to the present invention consists in that on the rim of a vessel component each of the elevations and depressions adjacently bears on the respective cheeks in direction of said connecting lines. Apart from the functional improvement this results in a further possibility of designing the decoration.

A further preferred embodiment of the dish vessel according to the present invention consists in that a common cheek is formed for one pair consisting of an elevation and a depression. Thereby the surface at which they border to each other, of the cheeks is enlarged when two vessel components are positioned on one another.

A preferred embodiment of the dish vessel according to the present invention is characterized in that at the bottom surface of the vessel component alternatingly depressions and elevations are recessed or seated, respectively, said depressions and elevations interlocking positively when two vessel components lie against one another with their bottom surfaces. By this embodiment of the dish vessel it will be also possible to pile up closed vessels each consisting of two vessel components or one vessel component, e.g. a plate, can be put on top of a closed vessel consisting of two vessel components.

A further preferred embodiment of the dish vessel according to the present invention is characterized in that the depressions and elevations have cheeks running in parallel to the rim of the vessel components and being in perpendicular position to the contact surfaces of the vessel components on the bottom surfaces thereof. Thus, the rims and the bottom surfaces of the vessel components show the same profile so that the profiles on one hand prevents the vessel components from shifting with respect to each other and on the other hand appears as uniform decoration.

A further preferred embodiment of the dish vessel according to the present invention is characterized in that the elevations and depressions form a continuous band. Thus, the space being available at the rims and at the bottom surface, with the profile preventing a lateral shifting of the vessel components is used best and the aesthetic form is improved, too.

Finally, a preferred embodiment of the dish vessel of the present invention is characterized in that the vessel components consist of elastic material and that the elevations and depressions can be mutually engaged. By the engagement of the elevations and depressions the resistance against a lateral shifting of the vessel components is further increased, as e.g. a closed vessel in which the two vessel components are pressed on one another with their rims in order to mutually insert the elevations and depressions, can only be opened again when a certain degree of force is applied. Closed vessels the vessel components of which are interlocked with one another with their bottom surfaces, also can only be separated again when applying a certain amount of force.

LIST OF FIGURES

Embodiments of the present invention will now be explained in more detail with respect to the drawings.

DETAILED ACCOUNT OF WORKING EXAMPLE OF THE INVENTION

Figure 1:
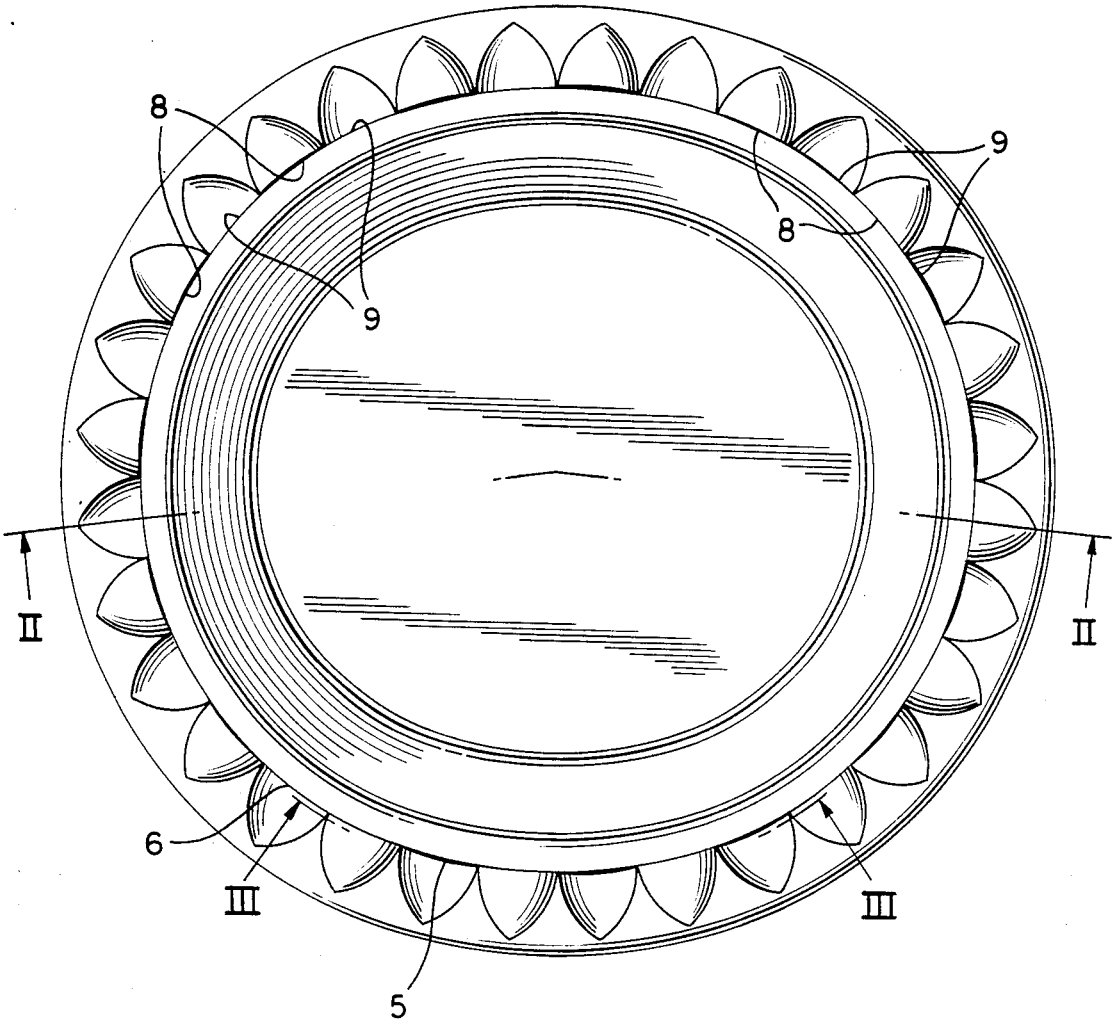
FIG. 1 is a top plan view of a first embodiment of a vessel component of the present invention, having a structural shape on the rim.
Figure 2:
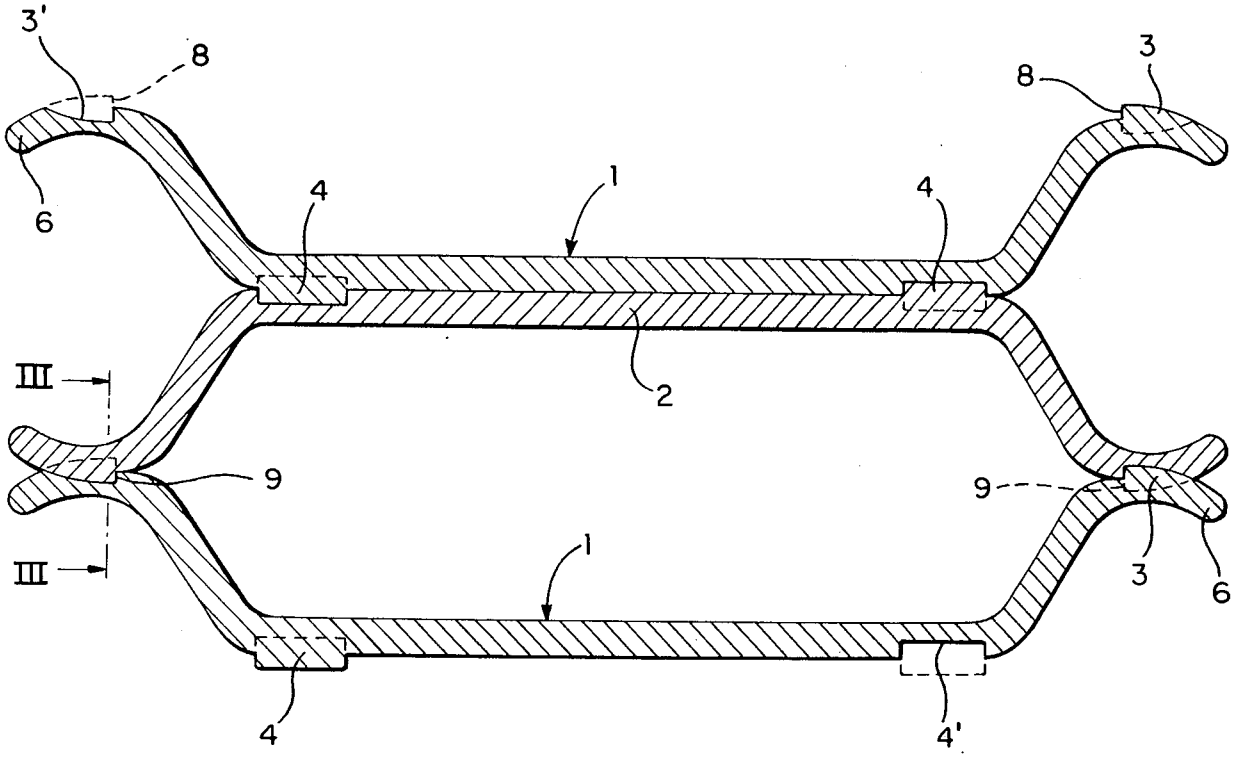
FIG. 2 is a section through a pile of vessel components according to FIG. 1.

In FIGS. 1 and 2 as vessel components are shown a plate 1 in top plan view (FIG. 1) and several plates being positioned on one another and piled up in the sense of receptacle and cover, in a sectional view (FIG. 2). A closed vessel is formed by one plate serving as receptacle and the other plate serving as cover and the contact surfaces of the two vessel components are formed horizontally so that the structural shapes on the rims of the vessel components can engage. The profiles consist of elevations 3 being arc-shaped in cross-section, i.e. in a section in parallel to the plate rim, and in longitudinal cross-section, i.e. in a section perpendicular to the plate rim, protruding from the rim 6, and depressions 3' merging into the rim. The elevations and depressions at one side have cheeks 8,9 being basically perpendicular to the rim and at the remaining sides steplessly merge into the rim. Therein the surfaces of the cheeks are basically perpendicular to a connecting line from the center of the vessel component to the center of the cheek. The stepless transition of the remaining sides of the elevations and depressions can be effected in a smooth arc or with a flat angle. The improved lateral retention therein is achieved by the cheeks 8 perpendicularly protruding over the horizontal contact surface in the circle curvature and/or the cheeks 9 countersunk in the horizontal contact surface, of the elevations and depressions. The cross-sectional form of the elevations and depressions may be circularly arc-shaped or sinsoidal and/or cosinusoidal. Therein the elevations 3 and depressions 3', merging into one another and sinusoidal-cosinusoidally swinging around the plate rim form an endless band 5 around the plate rim, wherein the cheeks 8, 9 are arranged at the insides of the elevations 3 and the depressions 3'. It is however also possible that the elevations and depressions do not form a continuous band, but are provided for individually.

At the bottom surface 2 of the plates 1 depressions 4' and elevations 4 are in alternating manner countersunk or seated in such manner that they interlock when the plates are positioned on one another with their bottom sides facing so that also in case of piling up the closed vessels formed by the plates 1, a lateral shifting of the plates against one another is not possible. The shape of the elevations 4 and the depressions 4' may correspond to the shape of the elevations 3 and the depressions 3'. It is however also possible to provide elevations 4 and depressions 4', having a rectangular longitudinal section, as is shown in FIG. 2.

Figure 3:
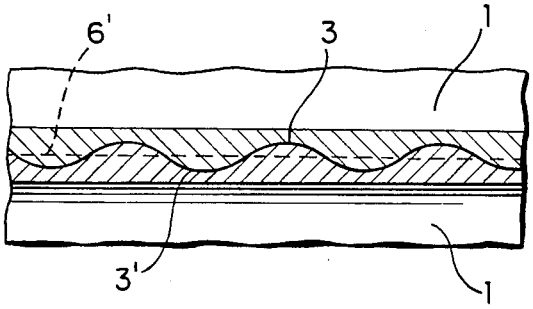
FIG. 3 is a section through the rims of two vessel components according to FIG. 1 which are positioned one on the other for forming a closed vessel.

FIG. 3 shows a section along the line III—III through the rims 6 of two plates 1 positioned on one another, in a lateral plan view and reveals how the elevations 3 protruding over the horizontal rims 6 lying on one another, and depressions 3' form a sinusoidal-cosinusoidal line or a wave lines in case of a direct lining-up.

Figure 4:
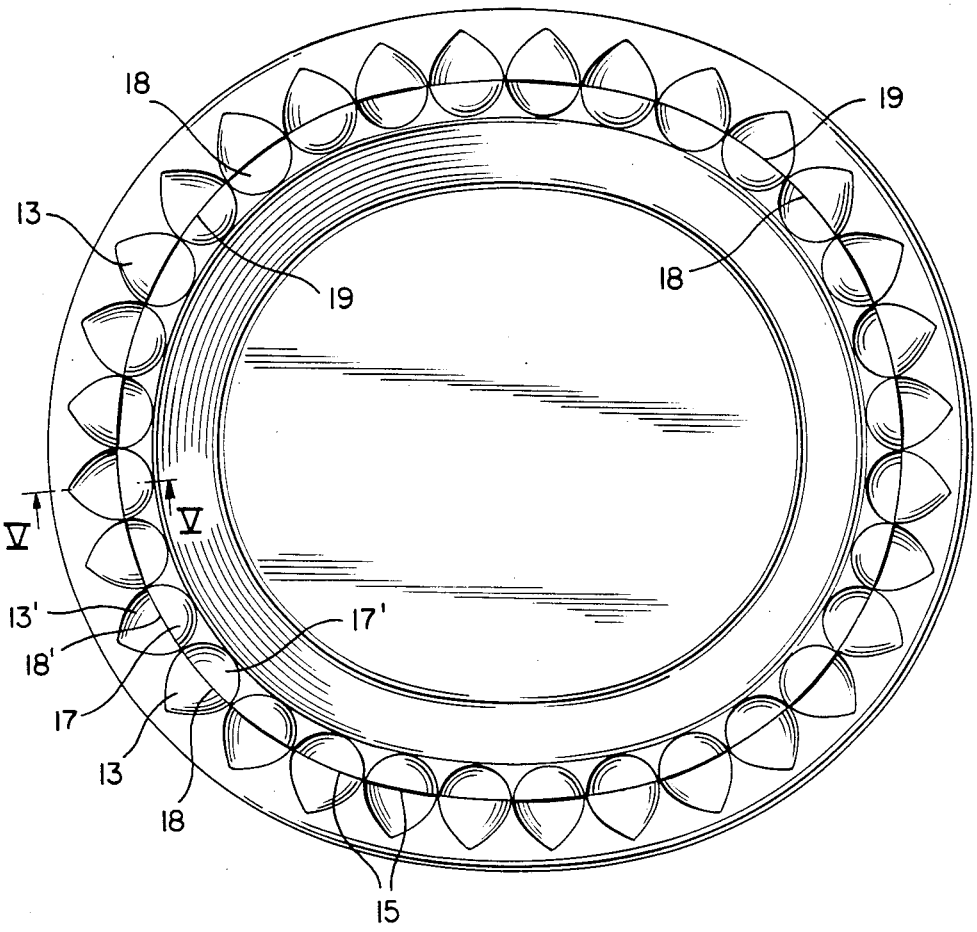
FIG. 4 is a top plan view of a second embodiment of the dish vessel of the present invention, having a modified structural shape on the rim.
Figure 5:
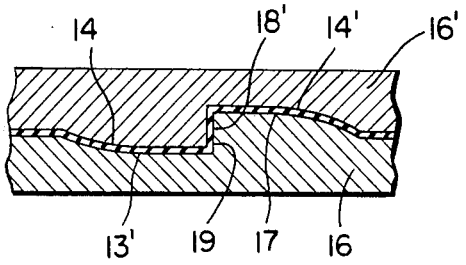
FIG. 5 is a section along line V—V of FIG. 4.

FIGS. 4 to 5 show a further embodiment of a plate. The plate shows elevations 13 and adjacent depressions 13', the cheeks 18 and/or 19 of which are arranged at the inner side of the relating elevations and depressions. Additional elevations 17 and depressions 17' are arranged at the inner sides of the elevations 13 and the depressions 13' such that their cheeks 18' and/or 18 lie on the outer side of the elevations 17 and/or depressions 17'. In the shown embodiment one pair of elevations 13 and depressions 17' or/and one pair of depressions 13' and elevations 17, respectively, form a common cheek, as can be seen from FIG. 5. By this embodiment the lateral retention is increased substantially. Therein the elevations and depressions, merging into one another and sinusoidal-cosinusoidally swinging around the plate rim form a band 15 running around the plate rim. Apart from that the elevations and depressions of the plate which is shown in FIGS. 4 to 5 are formed like in the first embodiment. It is not necessary that relating elevations and depressions of one pair form a common wall. Rather elevations and depressions with the respective relating cheeks may be arranged one beside the other on the rim of a vessel component, in direction of said connecting line so that a step is formed between the individual cheeks. It is also possible to flushingly arrange the elevations and depressions, extending from the cheeks to the center of the plate, and the elevations and/or depressions, respectively, extending from the cheeks to the plate rim, so that the elevations and depressions do not lie adjacent to each other with their cheeks.

The vessel components may be made of elastic material, e.g. of metal or plastics, and be formed such that the elevations are inserted in the depressions when the vessel components are pressed on one another.

The vessel components shown in FIGS. 1 to 3 as plates, can be built as flat plates, deep plates or also as bowls, the covers having the form of plates being simultaneously usable as cover or also as plate.

What is claimed:

1. Vessel comprising vessel components, the vessel component having rims on which profiles are arranged such that the profiles of two vessel components positioned one on the other and facing each other, interlock positively, the profiles being elevations and depressions having an arc shape in a cross-section parallel to the rim, the elevations protruding from the rim in a cross-section along the longitudinal direction of the elevations, and the depressions merging into the rim in a cross section along the longitudinal direction of the depressions, the profiles having on one end cheeks essentially perpendicular to the rim and at their remaining sides steplessly merging into the rim, the surfaces of the cheeks being essentially perpendicualr to a connecting line between a center of the vessel component and a center of the cheeks.

2. Vessel according to claim 1, wherein the cheeks of the elevations and depressions are arranged at the inner side of the elevations and depressions.

3. Vessel according to claim 1, wherein the cheeks of the elevations and depressions are arranged at the inner side and outer side of the elevations and depressions.

4. Vessel according to claim 3, wherein on the rim of a vessel component an elevation and a depression, respectively, lie adjacent to the relating cheeks in the direction of said connecting line.

5. Vessel according to claim 4, wherein a common cheek is formed for a pair of elevations and depressions.

6. Vessel according to claim 1, wherein on the bottom side of the vessel component alternatingly depressions and elevations are recessed or seated, positively interlocking when two vessel components lie on one another with facing bottom surfaces.

7. Vessel according to claim 6, wherein the depressions and elevations have cheeks perpendicular to the contact surfaces of the vessel components at the bottom surfaces and running in parallel to the vessel rim.

8. Vessel according to claim 2, wherein on the bottom side of the vessel component alternatively depressions and elevations are recessed or seated, positively interlocking when two vessel components lie on one another with facing bottom surfaces.

9. Vessel according to claim 8, wherein the depressions and elevations have cheeks perpendicular to the contact surfaces of the vessel components at the bottom surfaces and running in parallel to the vessel rim.

10. Vessel according to claim 3, wherein on the bottom side of the vessel component alternatively depressions and elevations are recessed or seated, positively interlocking when two vessel components lie on one another with facing bottom surfaces.

11. Vessel according to claim 10, wherein the depressions and elevations have cheeks perpendicular to the contact surfaces of the vessel components at the bottom surfaces and running in parallel to the vessel rim.

12. Vessel according to claim 4, wherein on the bottom side of the vessel component alternatively depressions and elevations are recessed or seated, positively interlocking when two vessel components lie on one another with facing bottom surfaces.

13. Vessel according to claim 12, wherein the depressions and elevations have cheeks perpendicular to the contact surfaces of the vessel components at the bottom surfaces and running in parallel to the vessel rim.

14. Vessel according to claim 5, wherein on the bottom side of the vessel component alternatively depressions and elevations are recessed or seated, positively interlocking when two vessel components lie on one another with facing bottom surfaces.

15. Vessel according to claim 14, wherein the depressions and elevations have cheeks perpendicular to the contact surfaces of the vessel components at the bottom surfaces and running in parallel to the vessel rim.

16. Vessel according to claim 1, wherein the elevations and depressions form an endless band.

17. Vessel according to claim 2, wherein the elevations and depressions form an endless band.

18. Vessel according to claim 3, wherein the elevations and depressions form an endless band.

19. Vessel according to claim 4, wherein the elevations and depressions form an endless band.

20. Vessel according to claim 5, wherein the elevations and depressions form an endless band.

21. Vessel according to claim 6, wherein the elevations and depressions form an endless band.

22. Vessel according to claim 7, wherein the elevations and depressions form an endless band.

23. Vessel according to claim 1, wherein the vessel components consist of elastic material and the elevations can be inserted into the depressions.

24. Vessel according to claim 2, wherein the vessel components consist of elastic material and the elevations can be inserted into the depressions.

25. Vessel according to claim 3, wherein the vessel components consist of elastic material and the elevations can be inserted into the depressions.

26. Vessel according to claim 4, wherein the vessel components consist of elastic material and the elevations can be inserted into the depressions.

27. Vessel according to claim 5, wherein the vessel components consist of elastic material and that the elevations can be inserted into the depressions.

28. Vessel according to claim 6, wherein the vessel components consist of elastic material and the elevations can be inserted into the depressions.

29. Vessel according to claim 7, wherein the vessel components consist of elastic material and the elevations can be inserted into the depressions.

30. Vessel according to claim 8, wherein the vessel components consist of elastic material and the elevations can be inserted into the depressions.

31. Vessel according to claim 1, wherein the cheeks of the elevations and depressions are arranged at the outer side of the elevations and depressions.

32. Vessel according to claim 31, wherein on the rim of a vessel component an elevation and a depression, respectively, lie adjacent to the relating cheeks in the direction of said connecting line.

33. Vessel according to claim 32, wherein a common cheek is formed for a pair of elevations and depressions.

* * * * *